United States Patent [19]

Gibas

[11] Patent Number: 4,484,167

[45] Date of Patent: Nov. 20, 1984

[54] ACTIVATING MAGNET, PARTICULARLY A STROKE MAGNET

[75] Inventor: Christoph Gibas, Neunkirchen, Fed. Rep. of Germany

[73] Assignee: bso Steuerungstechnik GmbH, Fed. Rep. of Germany

[21] Appl. No.: 554,802

[22] Filed: Nov. 23, 1983

[30] Foreign Application Priority Data

Nov. 27, 1982 [DE] Fed. Rep. of Germany ..... 3243999

[51] Int. Cl.[3] ..... H01F 7/08

[52] U.S. Cl. ..... 335/260; 335/278; 251/129

[58] Field of Search ..... 335/202, 251, 255, 260, 335/261, 278, 281; 251/129

[56] References Cited

U.S. PATENT DOCUMENTS

| | | | |
|---|---|---|---|
| 3,134,056 | 5/1964 | Eberle | 335/260 |
| 3,141,115 | 7/1964 | Lansky et al. | 335/260 X |
| 4,322,057 | 3/1982 | Yamanaka et al. | 335/278 X |
| 4,326,696 | 4/1982 | Ishikawa et al. | 335/260 X |

*Primary Examiner*—George Harris
*Attorney, Agent, or Firm*—Wigman & Cohen

[57] ABSTRACT

An activating magnet, particularly a stroke magnet, has a magnet housing (15) which closely surrounds the periphery of the coil (7) and abuts the spool (8) thereof. An armature (1) is arranged within the coil so as to be axially moveable therein, and a pressure-proof junction box (38) is rigidly connected with the magnet housing in which the connections (24) for the coil are located. In order to create a much simpler and more economical construction for a pressure-proof pole tube (3,4,6) on which the coil is arranged. The magnet housing is pressure-proof and abuts the pole tube on both sides of the coil, and a pole core (5) is penetrated by the activating ram (2), whereby the pole core on one side and the magnet housing on the other side are rigidly connected with each other by means of a connecting means (22). The connections for the coil are guided through and out of the wall of the magnet housing and the junction box is rigidly connected to the magnet housing on the side thereof where the coil connections protrude.

5 Claims, 1 Drawing Figure

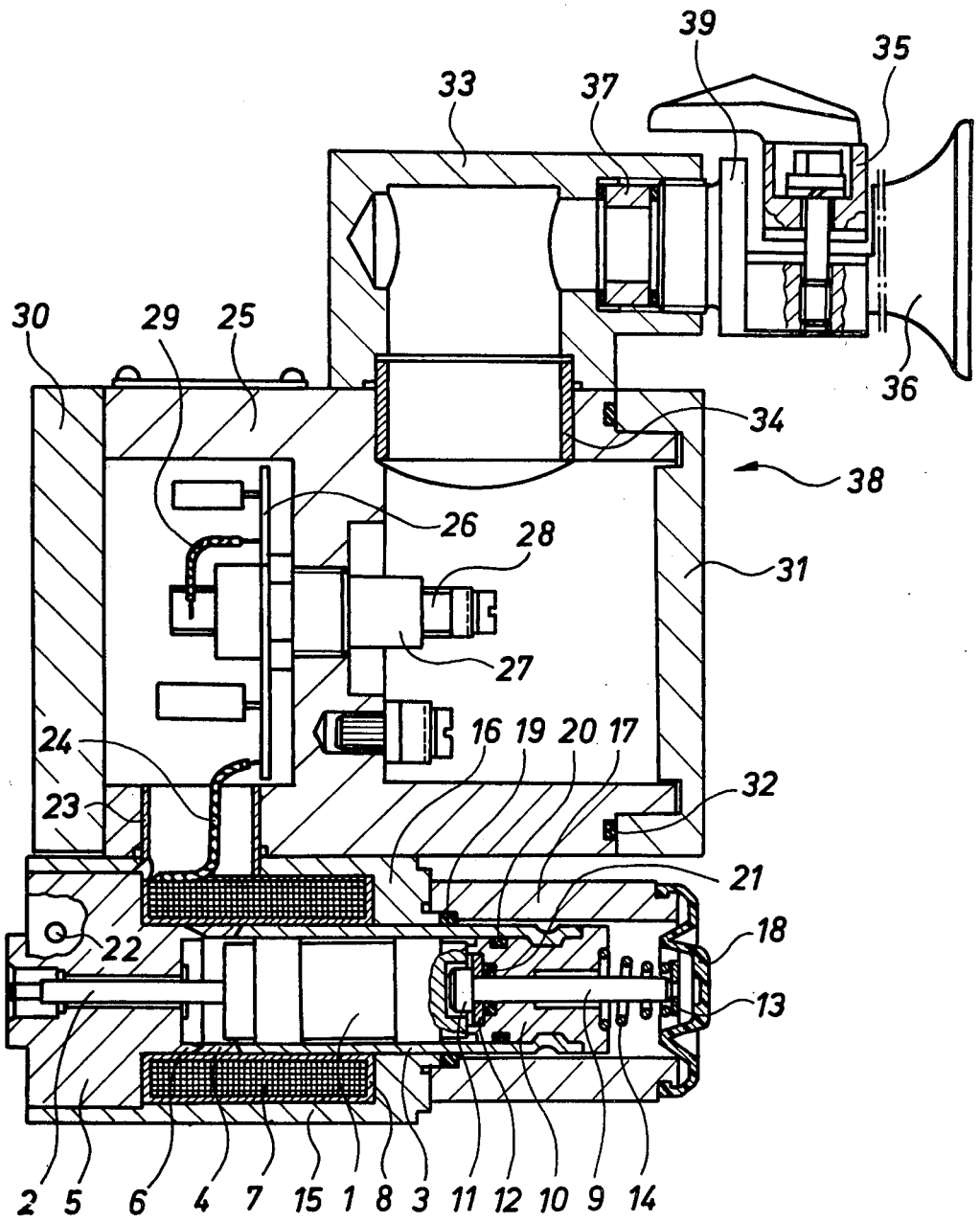
39
35
33
37
30
29
25
36
34
38
26
28
31
27
24
16
19
20
17
32
23
21
22
18
13
2
5
6
4
7
15
1
8
3
11
12
10
9
14

ACTIVATING MAGNET, PARTICULARLY A STROKE MAGNET

BACKGROUND OF THE INVENTION

The invention relates to an activating stroke magnet.

In order to make an activating stroke magnet pressure-proof, it is placed in a pressure-proof housing and an air space is maintained therebetween. To accomplish this, the magnet housing must be reworked. Because a pressure-proof housing is necessary in addition to the magnet housing, there is a significant increase in the weight of a pressure-proof magnet.

With magnets of this type, a ram passes through the magnet housing and through the pressure housing and the space required therefor may not exceed certain values with respect to its height and width. A pressure-proof activating magnet formed in this manner is relatively expensive, because of the large material expense and because of the precision machining required for various parts.

SUMMARY AND OBJECTS OF THE INVENTION

The object of the present invention is to create a significantly simpler and more economical construction for a pressure-proof activating magnet. This object is achieved according to the invention by the elimination of an additional housing and the accommodation of the armature and the ram in a pressure-proof chamber. This results in the pressure-proof activating magnet, formed in accordance with the invention, being significantly more economical than the known activating magnet. This is important, particularly for activating magnets which must exert relatively large adjusting forces.

A further object of the invention is to achieve a compact construction of an activating magnet by connecting the junction box and magnet housing by a melted-type connection.

BRIEF DESCRIPTION OF THE DRAWINGS

Additional advantages are found in the description and the drawing, wherein a stroke magnet is illustrated in longitudinal section as an exemplary embodiment of the object of the invention.

DETAILED DESCRIPTION OF A PREFERRED EMBODIMENT

An armature 1 has an activating ram 2, which can act on a push-rod (not shown) of a hydraulic or pneumatic valve. The armature 1 is surrounded with some play by a guide tube 3. Joined to the guide tube 3 in the direction of the ram 2 is a connecting ring 4 which is made of a non-magnetic material. The activating ram 2 is penetrated with play by a pole core 5, which is connected to the spacing ring 4 by means of a ring-like projection 6. A spool 8 which holds a coil 7 is arranged on the guide type 3, the spacing ring 4 and a tubular portion 6 of the pole core 5. The outside diameter of the pole core 5 on the left side of the spool as shown in the drawing is somewhat larger than the coil 7.

On the right side of the drawing is arranged an activating member for the armature 1. This armature 1 has a manually activated manual ram 9, which is mounted in a mounting body 10 arranged in the guide tube 3 so as to be axially slidable. The mounting body 10 has an annular groove about its circumference in which the guide tube 3 form-fittingly engages to fix the position of the mounting body 10. On the side toward the armature 1, the manual ram 9 has a head 11, which, in the illustrated position abuts a disc 12 which fits into the mounting body 10. On its opposite end, the manual ram 9 carries a support disc 13 to which it is rigidly connected. A compression spring 14 is biased between the mounting body 10 and the support disc 13, this spring being biased in the direction of removing the manual ram 9 from the armature 1 and holding it against the disc 12.

The outer peripheries of the pole core 5 and the coil are surrounded by a pressure-proof magnet housing 15, which has a floor 16 which is penetrated by the guide tube 3. One end of a protecting tube 17 is connected to an annular projection in the floor 16, the other end of the tube shown at the right in the drawing, which projects above the support disc 13 is covered by a structured cover 18 made of an elastic material, particularly rubber, which engages formfittingly along its inwardly projecting edge in an annular groove at the end of the protective tube 17. The space between the guide tube 3 and the protective tube 17, the mounting body 10 and the guide tube 3, as well as that between the manual ram 9 and the mounting body 10 are sealed respectively by sealing rings 19, 20 and 21. The sealing ring 19 also abuts the floor 16 of the magnet housing 15 on the frontal side of the projection. The chamber containing the armature 1 and the activating ram 2 is designed to be pressure-proof. The chamber in the magnet housing 15 containing the spool 8 and the coil 7 is also designed to be pressure-proof. The magnet housing 15 and the pole core 5 are connected with each other by means of pins 22.

The wall of the magnet housing 15 is penetrated by a bore in which is arranged a tubular element 23 disposed perpendicularly to the axis. This tubular element 23 contains a connecting wire 24 connected to the coil 7. The tubular element 23 also passes through one wall of a box housing 25 of a junction box 38, into which the connecting wire 24 extends. An attachment strip 26 is connected to the connecting wire 24 and is supported by hollow screw 27 which passes through a wall in the box housing 25. A connecting element 28 leads through this hollow screw 27, and is connected to the attachment strip 26 by means of a connecting wire 29. The box housing 25 is closed to the outside by a box cover 30 arranged on the side of the attachment strip 26. The chamber limited by this box cover 29 and which contains the attachment strip 26, is formed, together with the chamber containing the coil 7, in a pressure-proof manner. The box housing 25 is connected with the wall of the magnet housing 15 by means of a hard-solder connection. The chamber of the junction box containing the connecting element 28 is covered by a junction cover 31 as shown on the right side of the drawing.

On the side of the box housing 25 opposite the magnet housing 15, an angled support 33 is connected with the box housing 25, by means of a hard-solder connection. A tubular element 34 penetrates the wall of the box housing 25 in the vicinity of the chamber containing the connecting element 28 and projects into a recess in the angled support 33. The angled support 33 serves in the introduction of an electrical cable (not shown) into the chamber defined by the junction cover 31, which contains the connecting element 28.

The magnet housing 15, the box housing 25 and the angled support 32 are held in their respective relative positions by means of the tubular elements 23 and 34.

A fitting element 39 is screwed into the angled support 33, and has a fitting portion 35 which can be connected thereto by means of connecting screws. The fitting portion 35 serves to fix the position of the cable (not shown), which is introduced through a bell element 36 arranged on the side of the fitting element 39 opposite the angled support 33. A spacing element 37 is arranged between the fitting element 39 and the base of the bore containing the screw threading for this fitting element 39.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An activating magnet, particularly a stroke magnet, having a coil, comprising:

a magnet housing immediately surrounding the circumference of the coil;

a spool abutting the housing;

an armature arranged within the coil so as to be axially moveable therein;

a pressure-proof junction box rigidly connected to the magnet housing, containing connections of the coil; and a pressure-proof pole tube on which the coil is arranged, said magnet housing being pressure-proof and abuts the coil on the pole tube on both sides;

a pole core abutting the magnet housing;

an activating ram penetrating the pole core;

wherein the diameter of the pole core is larger than the coil in that the pole tube and the pole core on the one side and the magnet housing on the other side are rigidly connected with each other by means of a connecting means, in that the coil connections pass out of the magnet housing, and in that the junction box is rigidly connected with the magnet housing on the side thereof from which the coil connections protrude.

2. The activating magnet of claim 1, wherein the junction box and the magnet housing are connected with each other by a melted-type connection.

3. The activating magnet of claim 1, wherein the connecting means to connect the magnet housing with the pole core comprises a connecting pin.

4. The activating magnet of claim 2, wherein the connecting means to connect the magnet housing with the pole core comprises a connecting pin.

5. The activating magnet of claim 1, wherein the connection wire for the coil is contained in a tubular element which extends through a wall of the magnet housing and a box housing.

* * * * *